US010030513B2

(12) United States Patent
Patel

(10) Patent No.: US 10,030,513 B2
(45) Date of Patent: Jul. 24, 2018

(54) SINGLE TRIP MULTI-ZONE DRILL STEM TEST SYSTEM

(71) Applicant: Schlumberger Technology Corporation, Sugar Land, TX (US)

(72) Inventor: Dinesh Patel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 756 days.

(21) Appl. No.: 14/028,952

(22) Filed: Sep. 17, 2013

(65) Prior Publication Data

US 2014/0076546 A1 Mar. 20, 2014

Related U.S. Application Data

(60) Provisional application No. 61/702,869, filed on Sep. 19, 2012.

(51) Int. Cl.

| | |
|---|---|
| ***E21B 49/08*** | (2006.01) |
| ***E21B 33/12*** | (2006.01) |
| ***E21B 34/06*** | (2006.01) |
| ***E21B 47/06*** | (2012.01) |
| ***E21B 43/14*** | (2006.01) |
| ***E21B 49/00*** | (2006.01) |

(52) U.S. Cl.

CPC ..... *E21B 49/087* (2013.01); *E21B 33/12* (2013.01); *E21B 34/06* (2013.01); *E21B 43/14* (2013.01); *E21B 47/06* (2013.01); *E21B 47/065* (2013.01); *E21B 49/008* (2013.01)

(58) Field of Classification Search

CPC ..... E21B 47/06; E21B 34/06; E21B 49/00; E21B 47/065; E21B 33/12

See application file for complete search history.

(56) References Cited

U.S. PATENT DOCUMENTS

| | | | |
|---|---|---|---|
| 4,796,699 | A | 1/1989 | Upchurch |
| 4,856,595 | A | 8/1989 | Upchurch |
| 4,896,722 | A | 1/1990 | Upchurch |
| 4,915,168 | A | 4/1990 | Upchurch |
| 4,971,160 | A | 11/1990 | Upchurch |
| 5,050,675 | A | 9/1991 | Upchurch |
| 5,275,241 | A | 1/1994 | Vigor et al. |

(Continued)

OTHER PUBLICATIONS

U.S. Appl. No. 61/803,383, filed Mar. 19, 2013.

(Continued)

*Primary Examiner* — D. Andrews
*Assistant Examiner* — Ronald R Runyan

(57) ABSTRACT

A drill stem test string may include a tubular body having an axial bore formed at least partially therethrough. An axial flow valve may be coupled to the first tubular body and allow fluid to flow axially through the first tubular body when in an open state and prevent fluid from flowing axially through the first tubular body when in a closed state. A radial flow valve may be coupled to the first tubular body and allow fluid to flow radially through the first tubular body when in an open state and prevent fluid from flowing radially through the first tubular body when in a closed state. A seal assembly may be coupled to an outer surface of the first tubular body and positioned between a lower end of the first tubular member and the first radial flow valve.

17 Claims, 6 Drawing Sheets

(56) References Cited

U.S. PATENT DOCUMENTS

| | | | |
|---|---|---|---|
| 5,691,712 | A | 11/1997 | Meek et al. |
| 6,302,216 | B1 * | 10/2001 | Patel ..... E21B 21/103 166/321 |
| 7,363,972 | B2 | 4/2008 | Dybdahl |
| 7,775,273 | B2 | 8/2010 | Merlau et al. |
| 2002/0017386 | A1 | 2/2002 | Ringgenberg et al. |
| 2006/0225881 | A1 | 10/2006 | O'Shaughnessy et al. |
| 2008/0017373 | A1 * | 1/2008 | Jones ..... E21B 17/18 166/265 |
| 2008/0201080 | A1 | 8/2008 | Lovell et al. |
| 2008/0223585 | A1 | 9/2008 | Patel et al. |
| 2008/0289813 | A1 | 11/2008 | Gewily et al. |
| 2008/0314590 | A1 | 12/2008 | Patel |
| 2009/0008078 | A1 | 1/2009 | Patel |
| 2009/0025923 | A1 | 1/2009 | Patel et al. |
| 2009/0045974 | A1 | 2/2009 | Patel |
| 2009/0065199 | A1 | 3/2009 | Patel et al. |
| 2009/0066535 | A1 | 3/2009 | Patel et al. |
| 2009/0071651 | A1 | 3/2009 | Patel |
| 2009/0078427 | A1 | 3/2009 | Patel |
| 2009/0085701 | A1 | 4/2009 | Veneruso et al. |
| 2009/0090499 | A1 | 4/2009 | Lewis et al. |
| 2009/0151950 | A1 | 6/2009 | Patel |
| 2009/0166045 | A1 | 7/2009 | Wetzel et al. |
| 2009/0173505 | A1 | 7/2009 | Patel et al. |
| 2009/0211755 | A1 | 8/2009 | Dyer et al. |
| 2009/0260835 | A1 | 10/2009 | Malone |
| 2009/0283279 | A1 | 11/2009 | Patel et al. |
| 2009/0294124 | A1 | 12/2009 | Patel |
| 2010/0012313 | A1 | 1/2010 | Longfield et al. |
| 2010/0038074 | A1 | 2/2010 | Patel |
| 2010/0038093 | A1 | 2/2010 | Patel |
| 2010/0101788 | A1 | 4/2010 | Mennem et al. |
| 2010/0139930 | A1 | 6/2010 | Patel et al. |
| 2010/0175894 | A1 | 7/2010 | Debard et al. |
| 2010/0186953 | A1 | 7/2010 | Patel et al. |
| 2010/0200291 | A1 | 8/2010 | Patel et al. |
| 2010/0236774 | A1 | 9/2010 | Patel et al. |
| 2010/0270031 | A1 | 10/2010 | Patel |
| 2010/0294506 | A1 | 11/2010 | Rodriguez et al. |
| 2010/0300678 | A1 | 12/2010 | Patel et al. |
| 2011/0004812 | A1 | 1/2011 | Yang |
| 2011/0048122 | A1 | 3/2011 | Le Foll et al. |
| 2011/0056702 | A1 | 3/2011 | Sharma et al. |
| 2011/0079382 | A1 | 4/2011 | Patel |
| 2011/0079398 | A1 | 4/2011 | Patel et al. |
| 2011/0100620 | A1 | 5/2011 | Patel |
| 2011/0168403 | A1 | 7/2011 | Patel |
| 2011/0192596 | A1 | 8/2011 | Patel |
| 2011/0247825 | A1 | 10/2011 | Batho et al. |
| 2011/0247828 | A1 | 10/2011 | Patel et al. |
| 2011/0251728 | A1 | 10/2011 | Batho et al. |
| 2011/0284214 | A1 | 11/2011 | Ayoub et al. |
| 2011/0297393 | A1 | 12/2011 | Patel |
| 2012/0000651 | A1 | 1/2012 | Panga et al. |
| 2012/0006563 | A1 | 1/2012 | Patel et al. |
| 2012/0012312 | A1 | 1/2012 | Whitsitt et al. |
| 2012/0013482 | A1 | 1/2012 | Patel et al. |
| 2012/0085538 | A1 | 4/2012 | Guerrero et al. |
| 2012/0168146 | A1 | 7/2012 | Filas |
| 2012/0186825 | A1 | 7/2012 | Wang et al. |
| 2012/0199365 | A1 | 8/2012 | Patel et al. |
| 2012/0211242 | A1 | 8/2012 | Patel |
| 2012/0267119 | A1 | 10/2012 | Patel |
| 2012/0292044 | A1 | 11/2012 | Patel |
| 2012/0325484 | A1 | 12/2012 | Patel |
| 2013/0087903 | A1 | 4/2013 | Cherchali et al. |

OTHER PUBLICATIONS

International Search Report and Written Opinion issued in the related PCT Application PCT/US2013/060504, dated Dec. 17, 2013 (13 pages).

International Preliminary Report on patentability issued in the related PCT Application PCT/US2013/060504, dated Mar. 24, 2015 (8 pages).

* cited by examiner

SINGLE TRIP MULTI-ZONE DRILL STEM TEST SYSTEM

CROSS-REFERENCE TO RELATED APPLICATIONS

This application claims the benefit of a related U.S. Provisional Patent Application having Ser. No. 61/702,869, filed Sep. 19, 2012, entitled "Single Trip Multi-Zone Drill Stem Test System," to Dinesh Patel, the disclosure of which is incorporated by reference herein in its entirety.

BACKGROUND

Embodiments described herein generally relate to systems and methods for downhole well testing. More particularly, such embodiments relate to systems and methods for evaluating multiple subterranean rock layers or zones for their potential to produce hydrocarbons.

After a wellbore has been drilled into a subterranean formation, various zones of the formation are perforated using a perforating gun. Drill stem testing is then conducted with a downhole testing tool (known as a "drill stem testing tool") to evaluate the productive capacity, pressure, permeability, and/or nature of the reservoir fluids disposed within each zone. The downhole testing tool includes a tubular body having one or more packers adapted to seal the annulus between the tubular body and the wellbore wall, thereby isolating a particular zone. The tubular body also includes a valve that is actuated into an open position to allow fluid from the particular zone to flow through the tubular body and to the surface for testing.

Once drill stem testing is complete for the particular zone, the downhole testing tool is pulled out of the wellbore to enable the zone that was just tested to be hydraulically isolated from the rest of the wellbore. The zone may be hydraulically isolated by positioning a plug in the wellbore. The downhole testing tool may then be run back into the wellbore to test another zone, and the procedure is repeated for each zone.

Running the downhole testing tool in and out of the wellbore in multiple trips is time consuming and costly. What is needed, therefore, are improved systems and methods for evaluating multiple subterranean rock zones in a single trip in the wellbore.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A drill stem test string for use in a wellbore is disclosed. The drill stem test string may include a tubular body having an axial bore formed at least partially therethrough. An axial flow valve may be coupled to the first tubular body and allow fluid to flow axially through the first tubular body when in an open state and prevent fluid from flowing axially through the first tubular body when in a closed state. A radial flow valve may be coupled to the first tubular body and allow fluid to flow radially through the first tubular body when in an open state and prevent fluid from flowing radially through the first tubular body when in a closed state. A seal assembly may be coupled to an outer surface of the first tubular body and positioned between a lower end of the first tubular member and the first radial flow valve.

A downhole tool assembly is also disclosed. The downhole tool assembly may include a completion assembly and a drill stem test string at least partially disposed therein. The completion assembly may include first, second, and third screens that are axially offset from one another. The drills stem test string may include a first tubular body having an axial bore formed therethrough and a second tubular body disposed radially outward from the first tubular body. A lower end of the second tubular body may be positioned above a lower end of the first tubular body. An axial flow valve may be coupled to the first tubular body and allow fluid to flow axially through the first tubular body when in an open state and prevent the fluid from flowing axially through the first tubular body when in a closed state. A first radial flow valve may be coupled to the first tubular body and allow fluid to flow radially through the first tubular body when in an open state and prevent the fluid from flowing radially through the first tubular body when in a closed state. A second radial flow valve may be coupled to the first tubular body and allow fluid to flow radially through the first tubular body when in an open state and prevent the fluid from flowing radially through the first tubular body when in a closed state. The first radial flow valve may be positioned between the axial flow valve and the second radial flow valve, and an upper end of the second tubular member may be positioned between the first and second radial flow valves. A first seal assembly may be coupled to the first tubular body and positioned between the first and second screens. The first seal assembly may seal an annulus formed between the first tubular member and the completion assembly. A second seal assembly may be coupled to the second tubular body and positioned between the second and third screens. The second seal assembly may seal an annulus formed between the second tubular member and the completion assembly.

A method for testing fluid from two or more zones in a subterranean formation is also disclosed. The method may include running a completion assembly into a wellbore. The completion assembly may include first, second, and third screens that are axially offset from one another. A drill stem test string may also be run into the wellbore and at least partially into the completion assembly. The drill stem test string may include a first tubular body having an axial bore formed therethrough and a second tubular body disposed radially outward from the first tubular body. A lower end of the second tubular body may be positioned above a lower end of the first tubular body. An axial flow valve may be coupled to the first tubular body and allow fluid to flow axially through the first tubular body when in an open state and prevent the fluid from flowing axially through the first tubular body when in a closed state. A first radial flow valve may be coupled to the first tubular body and allow fluid to flow radially through the first tubular body when in an open state and prevent the fluid from flowing radially through the first tubular body when in a closed state. A second radial flow valve may be coupled to the first tubular body and allow fluid to flow radially through the first tubular body when in an open state and prevent the fluid from flowing radially through the first tubular body when in a closed state. The second radial flow valve may be positioned above the axial flow valve and the first radial flow valve.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered limiting of its scope.

DETAILED DESCRIPTION

Figure 1:
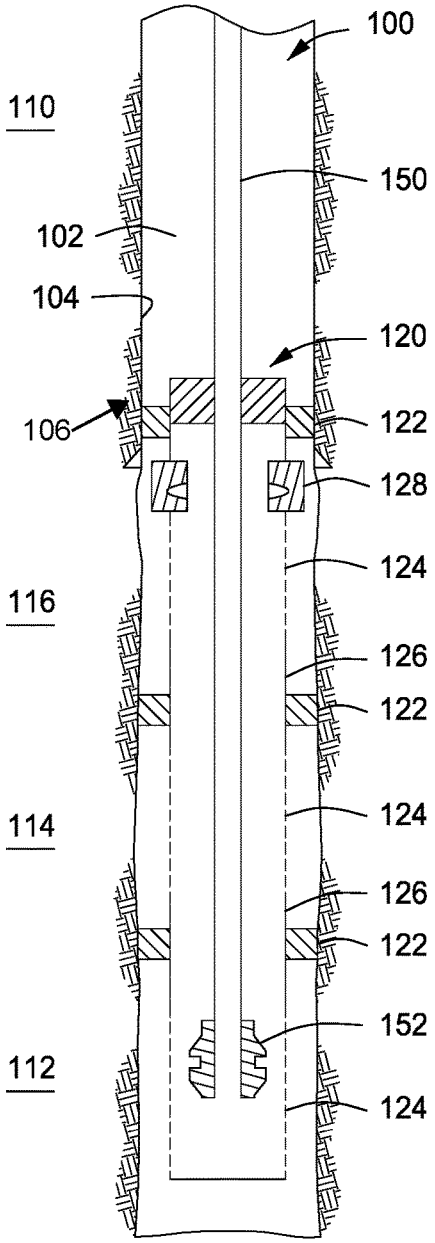
FIG. 1 depicts a schematic cross-section view of an illustrative completion assembly in a wellbore, according to one or more embodiments disclosed.

FIG. 1 depicts a schematic cross-section view of a wellbore 100 having a completion assembly 120 disposed therein, according to one or more embodiments. The completion assembly 120 may be run into the wellbore 100 on a work string 150. An annulus 102 may be formed between the completion assembly 120 and a casing 104 and/or wall 106 of the wellbore 100.

The completion assembly 120 may have one or more packers (three are shown 122) coupled to an outer surface thereof. The packers 122 may be or include mechanical packers, swellable packers, seal bore packers, or the like. Once the completion assembly 120 is in the desired location within the wellbore 100, the packers 122 may be actuated to anchor the completion assembly 120 in place. As shown, the first or "lower" packer 122 and the second or "intermediate" packer 122 may be swellable or mechanical packers adapted to expand outward into contact with the wall of the wellbore 100, and the third or "upper" packer 122 may be a seal bore packer adapted to expand outward into contact with the casing 104. Once expanded, the packers 122 may isolate multiple layers or zones of a subterranean formation 110. As shown, a first or "lower" zone 112, a second or "intermediate" zone 114, and a third or "upper" zone 116 may be isolated from one another by the packers 122.

The completion assembly 120 may also include a plurality of screens 124 that are axially and/or circumferentially offset from one another. At least one screen 124 may be disposed adjacent to each zone 112, 114, 116. The screens 124 may provide a path of fluid communication from the exterior of the completion assembly 120 (i.e., the annulus 102) to the interior of the completion assembly 120. The screens 124 may act as a filter such that fluid may flow therethrough to the interior of the completion assembly 120 while sand, gravel, and/or other particulates are prevented from passing therethrough and remain in the annulus 102.

The completion assembly 120 may also include one or more polished bore receptacles ("PBRs") 126. The polished bore receptacles 126 may be imperforate tubular members. At least one polished bore receptacle 126 may be disposed between two axially offset screens 124. The polished bore receptacles 126 may also be disposed radially inward from the packers 122.

The completion assembly 120 may further include a formation isolation valve ("FIV") 128. The formation isolation valve 128 may be positioned above the zones 112, 114, 116. As shown in FIG. 1, the formation isolation valve 128 is in an open state. In the open state, the formation isolation valve 128 allows fluid to flow axially therethrough within the interior of the completion assembly 120.

Figure 2:
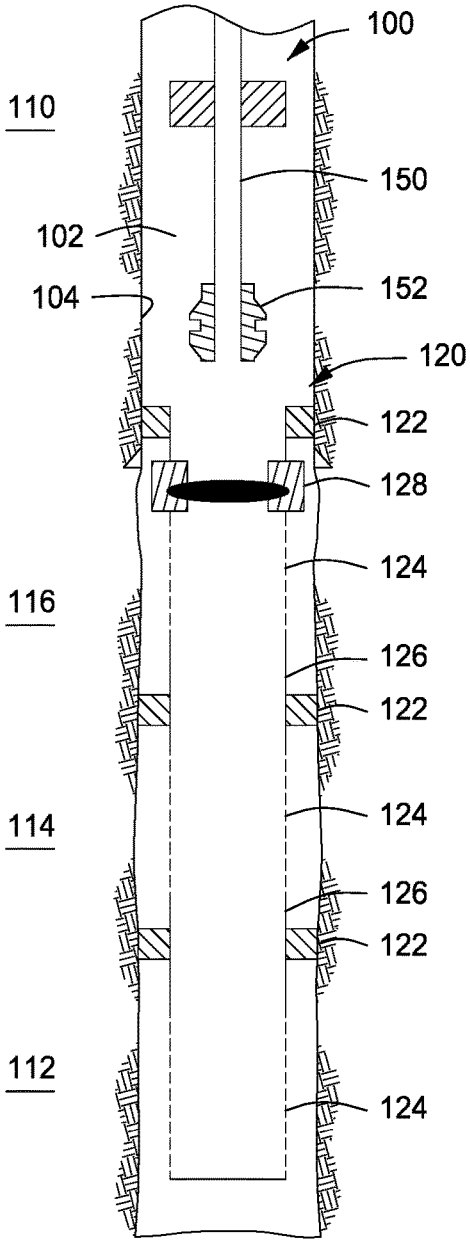
FIG. 2 depicts a schematic cross-section view of a work string being pulled out of the completion assembly shown in FIG. 1, according to one or more embodiments disclosed.

FIG. 2 depicts a schematic cross-section view of the work string 150 being pulled out of the completion assembly 120, according to one or more embodiments. The work string 150 may have a formation isolation valve shifting tool 152 coupled thereto. Once the packers 122 are set, and the completion assembly 120 is anchored in place, the work string 150 may be pulled toward the surface. The formation isolation valve shifting tool 152 may pass through and contact the formation isolation valve 128, causing the formation isolation valve 128 to actuate into a closed state, as shown in FIG. 2. In the closed state, the formation isolation valve 128 blocks or obstructs fluid flow axially therethrough within the interior of the completion assembly 120.

Figure 3:
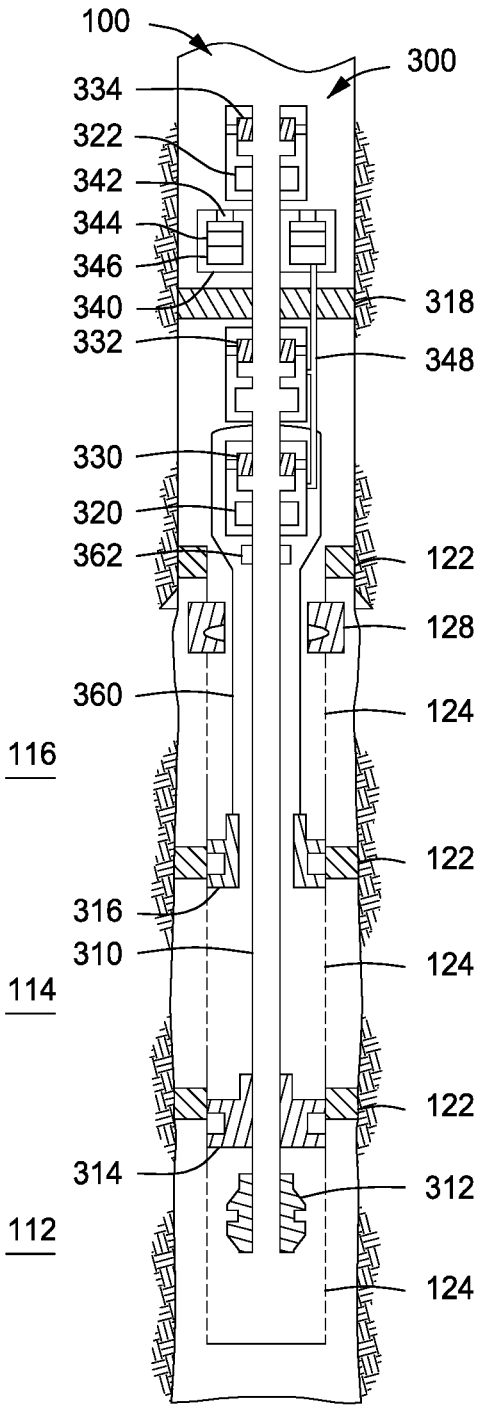
FIG. 3 depicts a schematic cross-section view of an illustrative multi-zone drill stem test string being run into the completion assembly shown in FIG. 1, according to one or more embodiments disclosed.

FIG. 3 depicts a schematic cross-section view of an illustrative multi-zone drill stem test string 300 being run at least partially into the completion assembly 120 shown in FIG. 1, according to one or more embodiments. The drill stem test string 300 may include a tubular body ("first tubular body") 310 having an axial bore formed at least partially therethrough. A formation isolation valve shifting tool 312 may be disposed on a lower end of the body 310. The shifting tool 312 may actuate the formation isolation valve 128 into the open state so that the drill stem test string 300 may be run at least partially into the completion assembly 120.

The drill stem test string 300 may have one or more axial flow valves 320, 322 coupled to the body 310. As shown, the drill stem test string 300 includes a first or "lower" axial flow valve 320, and a second or "upper" axial flow valve 322; however, more or fewer may be included. The axial flow valves 320, 322 may be or include ball valves and the like. The axial flow valves 320, 322 may be actuated between an open state and a closed state. In the open state, the axial flow valves 320, 322 allow fluid to flow axially therethrough within the interior of the drill stem test string 300. In the closed state, the axial flow valves 320, 322 block or obstruct fluid flow axially therethrough within the interior of the drill stem test string 300.

The drill stem test string 300 may also have one or more radial flow valves 330, 332, 334 coupled to the body 310. As shown, the drill stem test string 300 includes a first or "lower" radial flow valve 330, a second or "intermediate" radial flow valve 332, and a third or "upper" radial flow valve 334; however, more or fewer may be included. The radial flow valves 330, 332, 334 may be or include circulating valves and the like. The radial flow valves 330, 332, 334 may be actuated between an open state and a closed state. In the open state, the radial flow valves 330, 332, 334 allow fluid to flow radially therethrough between the interior of the drill stem test string 300 and the exterior of the drill stem test string 300. In the closed state, the radial flow valves 330, 332, 334 block or obstruct fluid flow radially therethrough between the interior of the drill stem test string 300 and the exterior of the drill stem test string 300. As shown, at least one of the axial flow valves 320, 322 and at least one of the radial flow valves 330, 332, 334 may be disposed within a common casing or housing creating a "dual valve."

The drill stem test string 300 may also have a hydraulic chamber 340 coupled to the body 310. The chamber 340 may be in fluid communication with the wellbore 300 via one or more ports or openings 342. As shown, the openings 342 place the chamber 340 in fluid communication with the annulus 102 between the drill stem test string 300 and the casing 104. The chamber 340 may have a piston 344 and a hydraulic fluid (e.g., clean oil) 346 disposed therein. The hydraulic chamber 340 may be adapted to provide hydraulic power to one or more of the axial flow valves 320, 322 and/or one or more of the radial flow valves 330, 332, 334. This may be accomplished by increasing the pressure of the fluid in the annulus 102 with a pump at the surface (not shown). The increased pressure in the annulus 102 may exert a force on the piston 344 that causes at least a portion of the hydraulic fluid 346 to flow through one or more hydraulic control lines 348 to the axial flow valve 320 and/or 322 and/or the radial flow valve 330, 332, and/or 334. The pressurized hydraulic fluid may be used to actuate the axial flow valve 320 and/or 322 and/or the radial flow valves 330, 332, and/or 334 between the open and closed states.

Each of the axial flow valves 320, 322 and each of the radial flow valves 330, 332, 334 may be actuated at a unique pressure signature. Said another way, any two or more of the axial flow valves 320, 322 and the radial flow valves 330, 332, and 334 may be actuated at different pressures with respect to one another. The pressure signature may be or include a predetermined pressure in the hydraulic line 348, a predetermined time that the pressure in the hydraulic line 348 is at the predetermined pressure, combinations thereof, and the like. For example, the lower axial flow valve 320 may actuate when the pressure in the hydraulic line increases by about 2 mPa for between about 30 seconds to about 60 seconds. The upper axial flow valve 322 may actuate when the pressure in the hydraulic line increases about 3.5 mPa for between about 120 seconds to about 180 seconds. As such, an operator at the surface may selectively actuate any one of the axial flow valves 320, 322 and/or any one of the radial flow valves 330, 332, 334 by manipulating the pump at the surface.

The drill stem test string 300 may also have a packer 318 coupled to an outer surface of the body 310. The packer 318 may be a modular retrievable packer adapted to expand outward into contact with the casing 104 to isolate upper and lower portions of the annulus 102. The hydraulic line 348 may extend axially through the packer 318, as shown.

A shroud or "second tubular body" 360 may be disposed radially outward from the body 310. A lower end of the shroud 360 may be positioned above a lower end of the body 310 and between the lower and intermediate zones 112, 114. An upper end of the shroud 360 may be coupled to the drill stem test string 300 between the lower and intermediate radial valves 330, 332.

The drill stem test string 300 may have one or more seal assemblies (two are shown 314, 316) coupled to the body 310. The first seal assembly 314 may be coupled to an outer surface of the body 310 and positioned between the lower end of the body 310 and the radial flow valve 330. The second seal assembly 316 may be coupled to an outer surface of the shroud 360 and positioned between the lower end of the shroud 360 and the radial flow valve 330. The drill stem test string 300 may be run into the completion assembly 120 until the seal assemblies 314, 316 are positioned between adjacent zones 112, 114, 116. For example, each seal assembly 314, 316 may be substantially adjacent to a corresponding packer 122 and/or polished bore receptacle 126. The first or "lower" seal assembly 314 may prevent fluid flow through the annulus formed between the body 310 of the drill stem test string 300 and the polished bore receptacle 126 of the completion assembly 120. The second or "upper" seal assembly 316 may prevent fluid flow through the annulus formed between the shroud 360 of the drill stem test string 300 and the polished bore receptacle 126 of the completion assembly 120, as discussed in more detail below.

Figure 4:
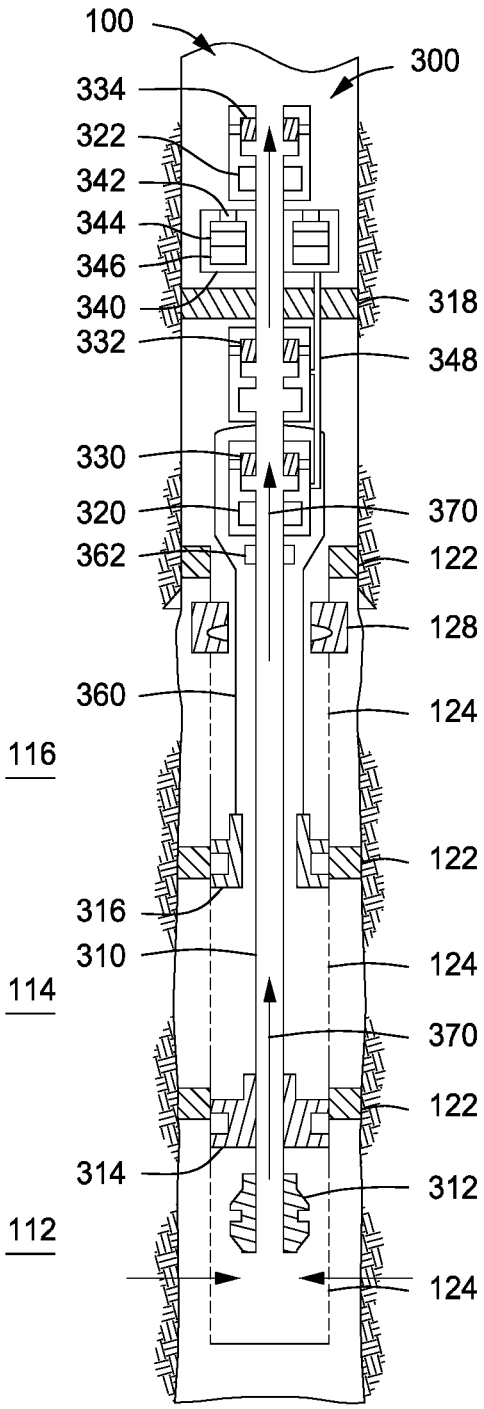
FIG. 4 depicts a schematic cross-section view of the drill stem test string shown in FIG. 3 testing a lower zone of the subterranean formation, according to one or more embodiments disclosed.
Figure 5:
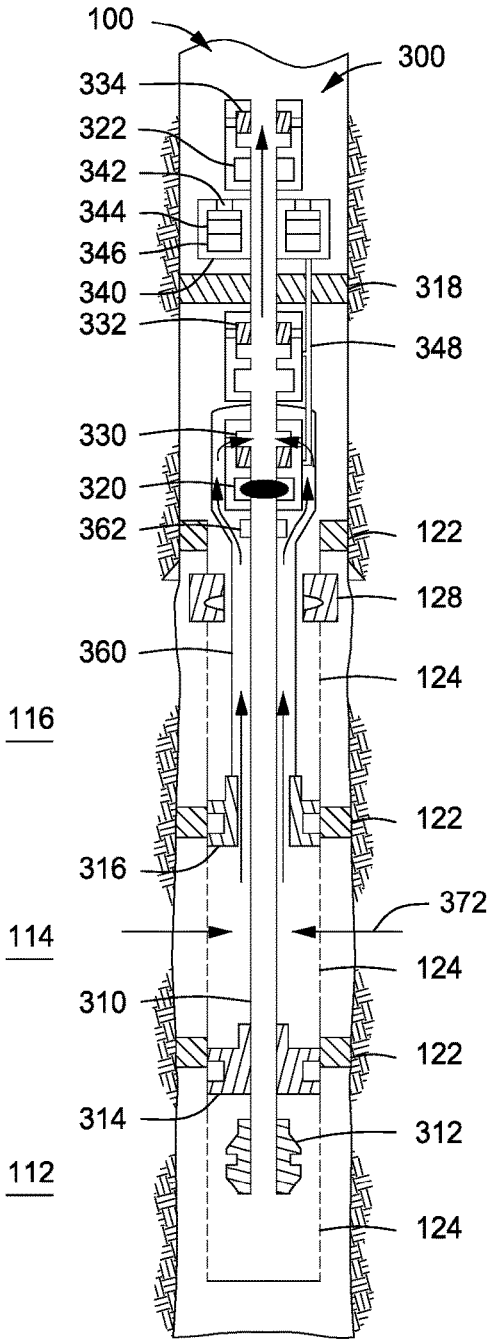
FIG. 5 depicts a schematic cross-section view of the drill stem test string shown in FIG. 3 testing an intermediate zone of the subterranean formation, according to one or more embodiments disclosed.
Figure 6:
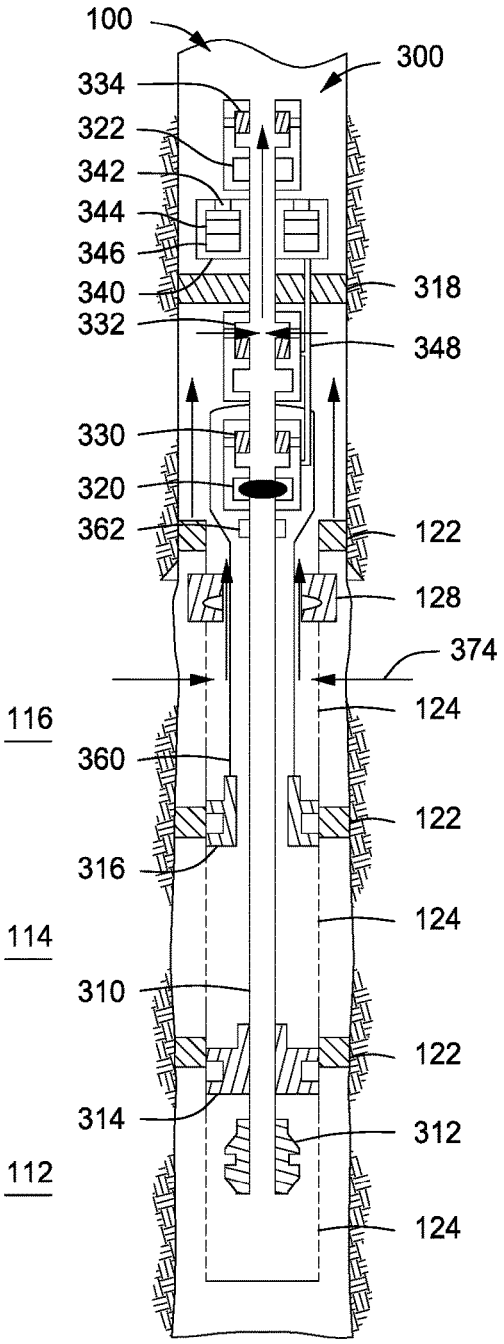
FIG. 6 depicts a schematic cross-section view of the drill stem test string shown in FIG. 3 testing an upper zone of the subterranean formation, according to one or more embodiments disclosed.

FIGS. 4-6 depict the operation of the drill stem test string 300 testing of the zones 112, 114, 116 of the subterranean formation 110. FIG. 4 depicts a schematic cross-section view of the drill stem test string 300 testing the lower zone 112 of the subterranean formation 110, according to one or more embodiments. Once the drill stem test string 300 is at least partially disposed within the completion assembly 120, the lower zone 112 may be tested. To test the lower zone 112, each of the axial flow valves 320, 322 may be in the open state, and each of the radial flow valves 330, 332, 334 may be in the closed state. Fluid (e.g., hydrocarbon fluid) from the lower zone 112 may flow through the screen 124 to the interior of the completion assembly 120. The fluid may then flow into the interior of the drill stem test string 300 and up toward the surface, as shown by the arrows 370. The flow path indicated by the arrows 370 may be referred to as the "first flow path." One or more sensors or gauges 362 may be coupled to the drill stem test string 300 to measure one or more properties of the fluid from the lower zone 112. For example, the sensor or gauge 362 may measure a temperature, pressure, viscosity, composition, flow rate, pH, water cut, and/or GOR of the fluid from the lower zone 112. These properties may also be measured at the surface.

The fluid from the lower zone 112 may flow to the surface for a predetermined amount of time (e.g., 24 hours). The fluid flow may then be obstructed by actuating the lower axial flow valve 320 into the closed state for a predetermined amount of time (e.g., 24 hours). The lower axial flow valve 320 may then be actuated back into the open state, and the properties of the fluid may again be measured by the one or more sensors or gauges 362 and/or at the surface. This process may be repeated two or more times for the lower zone 112.

FIG. 5 depicts a schematic cross-section view of the drill stem test string 300 testing the intermediate zone 114 of the subterranean formation 110, according to one or more embodiments. Once testing of the lower zone 112 is complete, the intermediate zone 114 may be tested. To test the intermediate zone 114, the lower axial flow valve 320 may be actuated into the closed state, and upper axial flow valve 322 may remain in the open state. The lower radial flow valve 330 may be actuated into the open state, and the intermediate and upper radial flow valves 332, 334 may remain in the closed state.

Fluid (e.g., hydrocarbon fluid) from the intermediate zone 114 may flow through the screen 124 to the interior of the completion assembly 120. The fluid may then flow up the annulus between the body 310 of the drill stem test string 300 and the shroud 360 and into the interior of the drill stem test string 300 through the lower radial flow valve 330, as shown by the arrows 372. This may be referred to as the "second flow path." The fluid may then flow up to the surface. The gauge 362 may measure one or more properties of the fluid from the intermediate zone 114 and/or the properties may be measured at the surface.

The fluid from the intermediate zone 114 may flow to the surface for a predetermined amount of time (e.g., 24 hours). The fluid flow may then be obstructed by actuating the lower radial flow valve 330 into the closed state for a predetermined amount of time (e.g., 24 hours). The lower radial valve 330 may then be actuated back into the open state, and the properties of the fluid may again be measured by the gauges 362 and/or at the surface. This process may be repeated two or more times for the intermediate zone 114.

FIG. 6 depicts a schematic cross-section view of the drill stem test string 300 testing the upper zone 116 of the subterranean formation 110, according to one or more embodiments. Once testing of the intermediate zone 114 is complete, the upper zone 116 may be tested. To test the upper zone 116, the lower axial flow valve 320 may be actuated into the closed state, and upper axial flow valve 322 may remain in the open state. The lower and upper radial flow valves 330, 334 may be actuated into the closed state, and the intermediate radial flow valve 332 may be actuated into the open state.

Fluid (e.g., hydrocarbon fluid) from the upper zone 116 may flow through the screen 124 to the interior of the completion assembly 120. The fluid may then flow up the annulus between the shroud 360 and the completion assembly 120 and into the interior of the drill stem test string 300 through the intermediate radial flow valve 332, as shown by the arrows 374. This may be referred to as the "third flow path." The fluid may then flow up to the surface. The gauges 362 may measure properties of the fluid from the upper zone 114 and/or the properties may be measured at the surface.

The fluid from the upper zone 116 may flow to the surface for a predetermined amount of time (e.g., 24 hours). The fluid flow may then be obstructed by actuating the intermediate radial flow valve 332 into the closed state for a predetermined amount of time (e.g., 24 hours). The intermediate radial valve 332 may then be actuated back into the open state, and the properties of the fluid may again be measured by the gauges 362 and/or at the surface. This process may be repeated two or more times for the upper zone 116.

Thus, as may be appreciated, the drill stem test string 300 may be used to test fluid from two or more zones 112, 114, 116 in the subterranean formation 110 during a single trip in the wellbore 100. Moreover, the fluid from the two or more zones 112, 114, 116 may be tested without axially moving the drill stem test string 300 within the wellbore 100. This may be accomplished by actuating one or more of the axial flow valves 320, 322 and/or one or more of the radial flow valves 330, 332, 334 between the open and closed states to utilize multiple flow paths.

Figure 7:
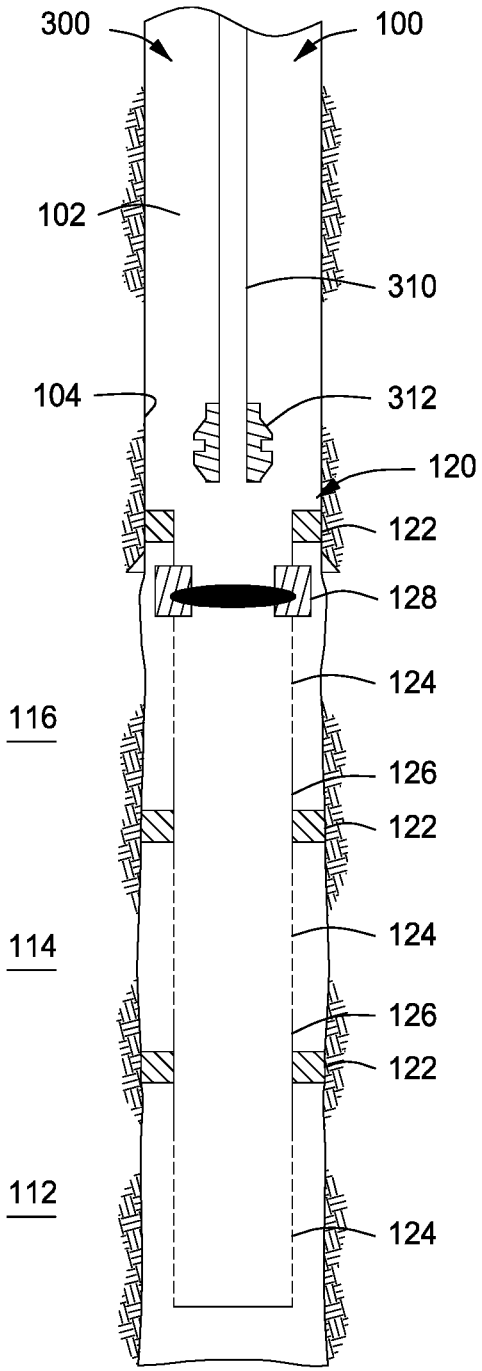
FIG. 7 depicts a schematic cross-section view of the drill stem test string shown in FIG. 3 being pulled out of the wellbore, according to one or more embodiments disclosed.

FIG. 7 depicts a schematic cross-section view of the drill stem test string 300 being pulled out of the wellbore 100, according to one or more embodiments. Once each of the zones 112, 114, 116 has been tested, the drill stem test string 300 may be pulled out of the wellbore 100. The formation isolation valve shifting tool 312 on the end of the drill stem test string 300 may pass through and contact the formation isolation valve 128, causing the formation isolation valve 128 to actuate into a closed state, as shown in FIG. 7. In the closed state, the formation isolation valve 128 blocks or obstructs fluid flow axially therethrough within the interior of the completion assembly 120.

Figure 8:
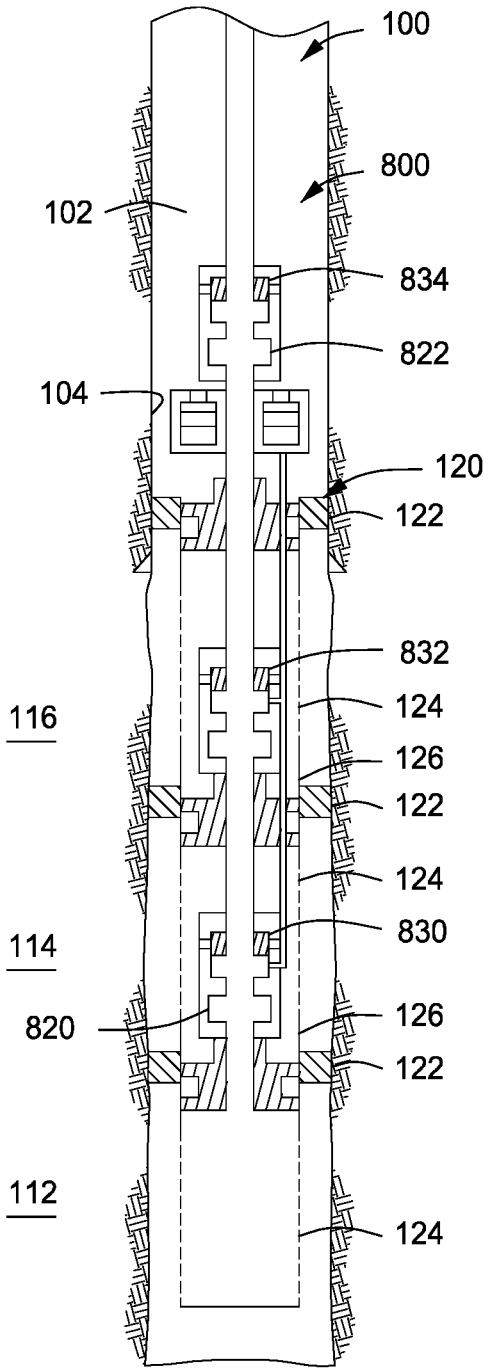
FIG. 8 depicts a schematic cross-section view of another illustrative drill stem test string being run into the wellbore, according to one or more embodiments disclosed.

FIG. 8 depicts a schematic cross-section view of another illustrative drill stem test string 800 disposed within the wellbore 100, according to one or more embodiments. The drill stem test string 800 of FIG. 8 may be similar to the drill stem test string 300 of FIG. 3; however, the drill stem test string 800 of FIG. 8 may utilize a single flow path to test each of the zones 112, 114, 116.

The lower axial flow valve 820 and the lower radial flow valve 830 may be positioned adjacent to the intermediate zone 114. The intermediate radial flow valve 832 may be positioned adjacent to the upper zone 116. The upper axial flow valve 822 and the upper radial flow valve 834 may be positioned above the upper zone 116.

To test the lower zone 112, each of the axial flow valves 820, 822 may be actuated into the open state, and each of the radial flow valves 830, 832, 834 may be actuated into the closed state. Fluid (e.g., hydrocarbon fluid) from the lower zone 112 may flow through the screen 124 to the interior of the completion assembly 120. The fluid may then flow into the interior of the drill stem test string 800 and up toward the surface. The gauges 862 may measure properties of the fluid from the lower zone 112 and/or the properties may be measured at the surface.

To test the intermediate zone 114, the lower axial flow valve 820 may be actuated into the closed state, and upper axial flow valve 822 may remain in the open state. The lower radial flow valve 830 may be actuated into the open state, and the intermediate and upper radial flow valves 832, 834 may remain in the closed state. Fluid (e.g., hydrocarbon fluid) from the intermediate zone 114 may flow through the screen 124 to the interior of the completion assembly 120. The fluid may then flow through the lower radial flow valve 830 into the interior of the drill stem test string 300 and up toward the surface. The gauges 862 may measure properties of the fluid from the intermediate zone 114 and/or the properties may be measured at the surface.

To test the upper zone 116, the lower axial flow valve 820 may be actuated into the closed state, and upper axial flow valve 822 may remain in the open state. The lower and upper radial flow valves 830, 834 may be actuated into the closed state, and the intermediate radial flow valve 832 may actuate into the open state. Fluid (e.g., hydrocarbon fluid) from the upper zone 116 may flow through the screen 124 to the interior of the completion assembly 120. The fluid may then flow through the intermediate radial flow valve 832 into the interior of the drill stem test string 800 and up toward the surface. The gauges 862 may measure properties of the fluid from the upper zone 116 and/or the properties may be measured at the surface.

Figure 9:
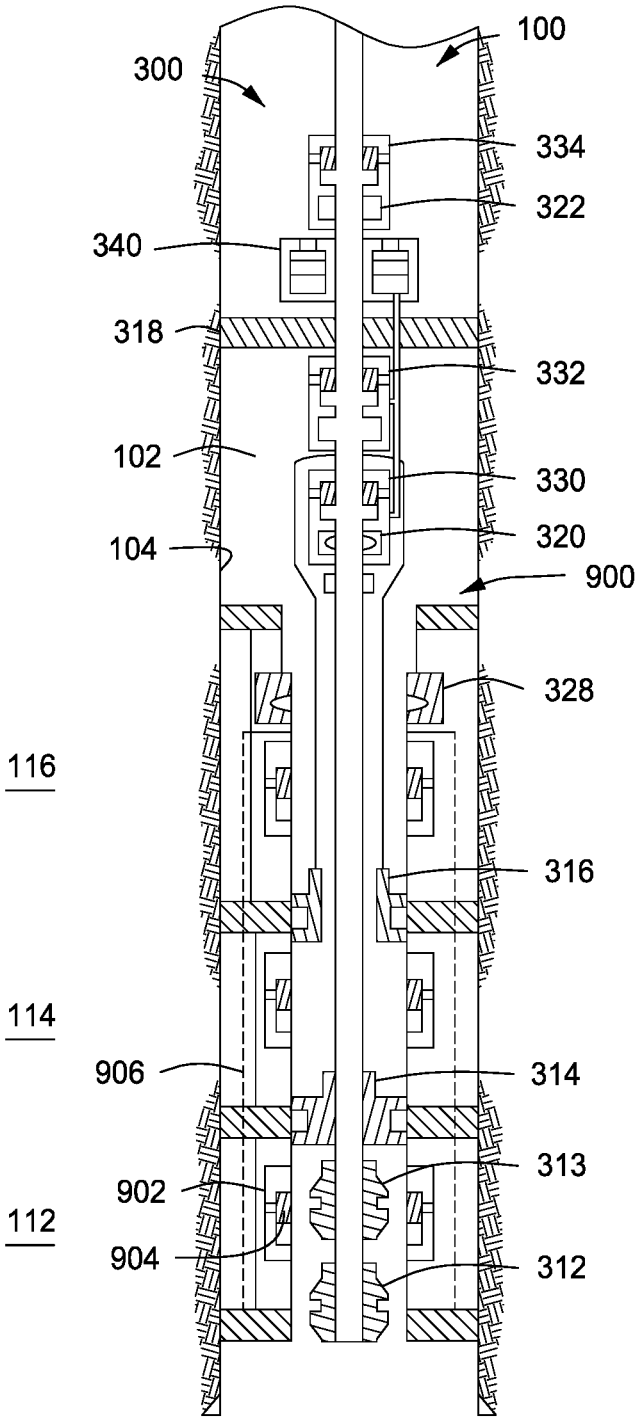
FIG. 9 depicts a schematic cross-section view of the drill stem test string shown in FIG. 3 being run into another illustrative completion assembly, according to one or more embodiments disclosed.

FIG. 9 depicts a schematic cross-section view of the drill stem test string 300 of FIG. 3 being run into another illustrative completion assembly 900, according to one or more embodiments. The completion assembly 900 may include one or more radial ports or openings 902 and a sliding sleeve 904, each positioned radially inward from a screen 906.

The drill stem test string 300 may include a sleeve shifting tool 313 coupled thereto. The sleeve shifting tool 313 may be adapted to engage one of the sliding sleeves 904 and to move the sliding sleeve 904 between an open state and a closed state. In the open state, fluid may flow between the annulus 102 and the interior of the completion assembly 900 through the opening 902. In the closed state, the sleeve 904 may block or obstruct the opening 902, thereby preventing fluid flow between the annulus 102 and the interior of the completion assembly 900.

Figure 10:
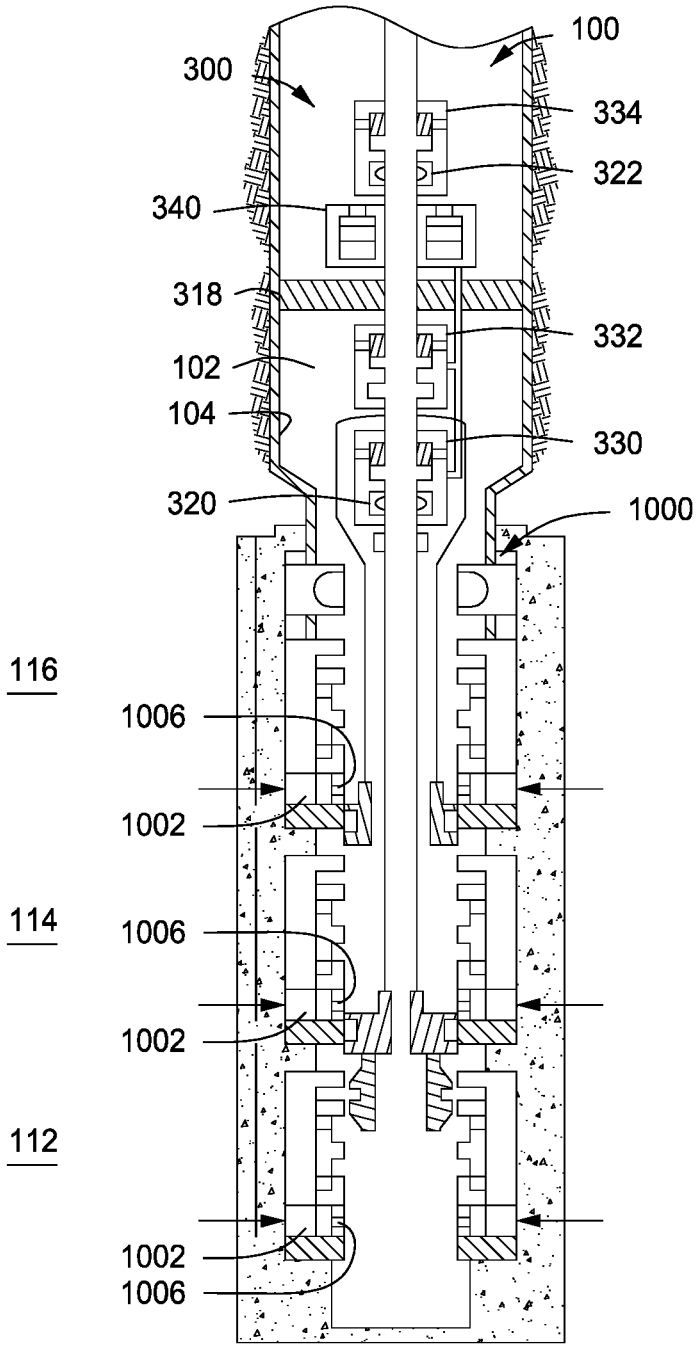
FIG. 10 depicts a schematic cross-section view of the drill stem test string shown in FIG. 3 being run into another illustrative completion assembly, according to one or more embodiments disclosed.

FIG. 10 depicts a schematic cross-section view of the drill stem test string 300 of FIG. 3 being run into another illustrative completion assembly 1000, according to one or more embodiments. Cement may be disposed within the annulus 102 between the completion assembly 1000 and the wall of the wellbore 100. The zones 112, 114, 116 may be fracked one at a time through the port or opening 1002 in completion assembly 1000. After each zone 112, 114, 116 has been fracked, a screen 1006 may be placed adjacent to each opening 1002 using a shifting tool coupled to a work string (not shown). The work string may then be pulled out of the wellbore 100, and the drill stem test string 300 may be run into the wellbore 100 until it is at least partially disposed within the completion assembly 1000. Once in position, the drill stem test string 300 may operate in the same manner as the drill stem test string 300 in FIGS. 4-6.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Although the preceding description has been described herein with reference to particular means, materials, and embodiments, it is not intended to be limited to the particulars disclosed herein; rather, it extends to all functionally equivalent structures, methods, and uses, such as are within the scope of the appended claims.

Although only a few example embodiments have been described in detail above, those skilled in the art will readily appreciate that many modifications are possible in the example embodiments without materially departing from "Single Trip Multi-Zone Drill Stem Test System." Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 120, paragraph 6 for any limitations of any of the claims herein, except for those in which the claim expressly uses the words 'means for' together with an associated function.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

What is claimed is:

1. A drill stem test string, comprising:

a first tubular body having an axial bore formed at least partially therethrough;

a first axial flow valve coupled to the first tubular body and adapted to allow fluid to flow axially through the first tubular body when in an open state and to prevent fluid from flowing axially through the first tubular body when in a closed state;

a first radial flow valve coupled to the first tubular body and adapted to allow fluid to flow radially through the first tubular body when in an open state and to prevent fluid from flowing radially through the first tubular body when in a closed state;

a packer coupled to the outer surface of the first tubular body and located above the first axial flow valve and the first radial flow valve, the packer being adapted to expand outward into contact with a casing within a wellbore;

a seal assembly coupled to an outer surface of the first tubular body and positioned between a lower end of the first tubular and the first radial flow valve;

a second tubular body disposed radially outward from the first tubular body, wherein a lower end of the second tubular body is positioned above a lower end of the first tubular body;

a second radial flow valve coupled to the first tubular body and adapted to allow fluid to flow radially through the first tubular body when in an open state and to prevent fluid from flowing radially through the first tubular body when in a closed state, wherein the second radial flow valve is positioned above the first axial flow valve and the first radial flow valve and above an upper end of the second tubular member, and wherein the first axial flow valve, the first radial flow valve, and the second radial flow valve are each actuated by a different pressure signature of fluid in an annulus between the drill stem test string and the casing; and a third radial flow valve coupled to the first tubular body and located above the packer and the second radial flow valve.

2. The drill stem test string of claim 1, wherein the first axial flow valve is positioned below the first and second radial flow valves.

3. The drill stem test string of claim 1, wherein an upper end of the second tubular member is positioned between the first and second radial flow valves.

4. The drill stem test string of claim 1, wherein the first axial flow valve, the first radial flow valve, and the second radial flow valve are each positioned above the lower end of the second tubular member.

5. The drill stem test string of claim 1, further comprising a shifting tool coupled to the first tubular body for actuating a formation isolation valve.

6. The drill stem test string of claim 1, further comprising a gauge coupled to the first tubular member and adapted to measure a pressure of the fluid, a temperature of the fluid, a flow rate of the fluid, a viscosity of the fluid, a composition of the fluid, a pH of the fluid, or a combination thereof.

7. The drill stem test string of claim 1, wherein the drill stem test string is adapted to test fluid from two or more zones in a subterranean formation during a single trip in the wellbore without axial movement of the drill stem test string.

8. A downhole tool assembly, comprising:

a completion assembly including first, second, and third screens that are axially offset from one another; and a drill stem test string disposed at least partially in the completion assembly, the drill stem test string including:

a first tubular body having an axial bore formed at least partially therethrough;

a second tubular body disposed radially outward from the first tubular body, wherein a lower end of the second tubular body is positioned above a lower end of the first tubular body;

a first axial flow valve coupled to the first tubular body and adapted to allow fluid to flow axially through the first tubular body when in an open state and to prevent the fluid from flowing axially through the first tubular body when in a closed state;

a first radial flow valve coupled to the first tubular body and adapted to allow fluid to flow radially through the first tubular body when in an open state and to prevent the fluid from flowing radially through the first tubular body when in a closed state;

a second radial flow valve coupled to the first tubular body and adapted to allow fluid to flow radially through the first tubular body when in an open state and to prevent the fluid from flowing radially through the first tubular body when in a closed state, wherein the first radial flow valve is positioned between the first axial flow valve and the second radial flow valve, and wherein an upper end of the second tubular member is positioned between the first and second radial flow valves, and wherein the first axial flow valve, the first radial flow valve, and the second radial flow valve are each actuated by a different pressure signature of fluid in an annulus between the drill stem test string and a casing;

a first seal assembly coupled to the first tubular body and positioned between the first and second screens, wherein the first seal assembly seals an annulus formed between the first tubular member and the completion assembly;

a second seal assembly coupled to the second tubular body and positioned between the second and third screens, wherein the second seal assembly seals an annulus formed between the second tubular member and the completion assembly;

a packer coupled to the first polished bore receptacle and extending between the first polished bore receptacle and a wall of the wellbore; and a third radial flow valve coupled to the first tubular body and located above the packer and the second radial flow valve.

9. The downhole tool assembly of claim 8, further comprising the first polished bore receptacle positioned axially between the first and second screens, wherein the first seal assembly extends between the first polished bore receptacle and the first tubular member.

10. The downhole tool assembly of claim 9, further comprising a second polished bore receptacle positioned axially between the second and third screens, wherein the second seal assembly extends between the second polished bore receptacle and the second tubular member.

11. The downhole tool assembly of claim 8, wherein the drill stem test string is adapted to test fluid from two or more zones in the subterranean formation during a single trip in the wellbore without axial movement of the drill stem test string.

12. A method for testing fluid from two or more zones in a subterranean formation, comprising:

running a completion assembly into a wellbore, the completion assembly including first, second, and third screens that are axially offset from one another; and running a drill stem test string into the wellbore and at least partially into the completion assembly, the drill stem test string including:

a first tubular body having an axial bore formed therethrough, a second tubular body disposed radially outward from the first tubular body, wherein a lower end of the second tubular body is positioned above a lower end of the first tubular body, a first axial flow valve coupled to the first tubular body and adapted to allow fluid to flow axially through the first tubular body when in an open state and to prevent the fluid from flowing axially through the first tubular body when in a closed state, a first radial flow valve coupled to the first tubular body and adapted to allow fluid to flow radially through the first tubular body when in an open state and to prevent the fluid from flowing radially through the first tubular body when in a closed state, a second radial flow valve coupled to the first tubular body and adapted to allow fluid to flow radially through the first tubular body when in an open state and to prevent the fluid from flowing radially through the first tubular body when in a closed state, wherein the second radial flow valve is positioned above the axial flow valve and the first radial flow valve, and wherein the first axial flow valve, the first radial flow valve, and the second radial flow valve are each actuated by a different pressure signature of fluid in an annulus between the drill stem test string and a casing, a packer coupled to the outer surface of the first tubular body and located above the first axial flow valve and the first radial flow valve, the packer being adapted to expand outward into contact with the casing within a wellbore, and a third radial flow valve coupled to the first tubular body and located above the packer and the second radial flow valve; and increasing pressure in an annulus between the drill stem test string and the casing of the wellbore to actuate at least one of the first axial flow valve, the first radial flow valve, and the second radial flow valve.

13. The method of claim 12, further comprising:

positioning a first seal assembly coupled to the first tubular body between the first and second screens; and positioning a second seal assembly coupled to the second tubular body between the second and third screens.

14. The method of claim 13, further comprising actuating the axial flow valve into the open state to allow fluid from a first zone in the subterranean formation to flow into the first tubular body, through the axial flow valve, and to the surface.

15. The method of claim 14, further comprising actuating the first radial flow valve into the open state to allow fluid from a second zone in the subterranean formation to flow into the first tubular member via the first radial flow valve and to the surface.

16. The method of claim 15, further comprising actuating the second radial flow valve into the open state to allow fluid from a third zone in the subterranean formation to flow into the first tubular member via the second radial flow valve and to the surface.

17. The method of claim 16, further comprising measuring a pressure of the fluid, a temperature of the fluid, a flow rate of the fluid, or a combination thereof.

* * * * *